United States Patent [19]

Kemeny

[11] Patent Number: 4,722,146

[45] Date of Patent: Feb. 2, 1988

[54] PORTABLE DISPLAY PANEL APPARATUS

[76] Inventor: Matthias D. Kemeny, 1625 SW. Westwood Ct., Portland, Oreg. 97201

[21] Appl. No.: 836,002

[22] Filed: Mar. 4, 1986

[51] Int. Cl.[4] ..... G09F 7/00

[52] U.S. Cl. ..... 40/605; 52/822; 160/135

[58] Field of Search ..... 40/605, 606; 52/284, 52/563, 783, 784, 821, 822; 411/913, 22, 512; 160/199, 135; 16/225

[56] References Cited

U.S. PATENT DOCUMENTS

| | | | |
|---|---|---|---|
| 2,709,290 | 5/1955 | Rosenthal | 411/512 |
| 2,734,789 | 2/1956 | Wilson, Jr. | 52/784 |
| 3,233,503 | 2/1966 | Fernberg | 411/913 |
| 3,592,289 | 7/1971 | Aysta et al. | 160/135 |
| 3,695,330 | 10/1972 | Hasbrouck | 160/135 |
| 3,862,523 | 1/1975 | Eaton | 40/606 |
| 3,889,736 | 6/1975 | Firks | 160/135 |
| 4,030,219 | 6/1977 | Donovan | 40/605 |
| 4,060,294 | 11/1977 | Haworth et al. | 160/135 |
| 4,566,211 | 1/1986 | Gustafson et al. | 40/605 |

FOREIGN PATENT DOCUMENTS

| | | | |
|---|---|---|---|
| 2069212 | 8/1981 | United Kingdom | 160/135 |

*Primary Examiner*—Gene Mancene
*Assistant Examiner*—Cary E. Stone
*Attorney, Agent, or Firm*—Chernoff, Vilhauer, McClung & Stenzel

[57] ABSTRACT

A portable display unit including a plurality of panels hingedly connected along adjacent vertical sides with an upper set of panels connected by a single resiliently compressible fastener extending from frame to frame of vertically adjacent panels. A frame assembly for each panel provides sufficient structural support for panels having lightweight foam cores and adhesively attached outer sheets. Fabric hinges permit a set of panels to be stacked closely, without disassembly, for storage and shipment. Individual panel faces are replaceable and the interior of a panel unit may be illuminated in one embodiment of the invention.

19 Claims, 12 Drawing Figures

PORTABLE DISPLAY PANEL APPARATUS

BACKGROUND OF THE INVENTION

The present invention relates to vertical display panel units and particularly to a portable folding display unit having improved frame construction, hinges, and fastening devices for interconnecting adjacent panel units.

Vertical display panels are used by educators, for displaying course materials and the like, and by manufacturers and other businessmen to display their materials at trade shows, sales meetings and the like, and are generally useful in many similar or related situations. Particularly in the case of displays to be used by manufacturers, educators, and salesmen to disclose and display the same materials at several successive exhibitions it is desirable for display panel units to be quickly and easily erected or disassembled and packed for shipping. Displays which are difficult to set up require longer lead time. Added costs are incurred when displays must be shipped ahead to be erected in advance of the scheduled opening of an exhibition, instead of merely being carried as baggage accompanied by the personnel who will be making presentations illustrated by the displays.

Preferably, such display devices are sturdy enough to support not only printed material but small samples or models. Nevertheless the display devices should be as light in weight as possible consistent with the required strength, so that the costs of shipping displays by air carrier are minimized, and so that the displays may be carried and set up easily by people of ordinary size and strength.

It is highly desirable that a display unit have no loose connecting parts or pieces which might be lost during travel or the process of erection or disassembly of a display. Nevertheless, a display unit should be capable of being packed in containers small enough to be carried in passenger vehicles, when possible, in order to minimize transportation difficulties.

Ideally, the above-described desirable features could be provided in an inexpensive display unit. Additionally, it is desirable to provide a display device which permits exchange of panels including permanently affixed display material, and which permits internal illumination of a display unit.

In the past, sturdy, lightweight panel display units have been constructed with wooden frames surrounding lightweight synthetic plastic foam core material. Protective metal frame members are attached to the wooden frame by wood screws and similar fasteners, because no better or more economical construction has been generally known to the industry, although use of such fasteners is undesirably time-consuming and expensive. For displays of significant height, upper panel sections have been connected to lower panel sections by pin-and-socket arrangements which are only marginally satisfactory, as they are difficult to align for assembly and may be difficult to disassemble because of the tendency of the pin-and-socket arrangements to become jammed because of misalignment.

Laterally adjacent individual panel members have previously been interconnected by hinges which must be pinned together during erection of the display unit assembly. Separation of the hinged members upon disassembly of a display has presented the risk of loss of hinge pins and related fasteners. As a result, the previously known display units for portable displays have been less than satisfactory in their cost, their weight, and their convenience for assembly and disassembly.

What is desired, then, is an improved vertical panel display device which is sturdy, yet light in weight, inexpensive to manufacture, and easy to assemble during manufacture, and which permits repeated interconnection and separation of upper and lower panel units without difficulty, and which permits displays to be folded and packed for transportation without disassembly and potential loss of parts of hinges or other interconnecting devices.

SUMMARY OF THE INVENTION

The present invention provides a display unit which overcomes the aforementioned shortcomings and disadvantages of the previously available display units. The display unit of the present invention is inexpensive to construct, in comparison with previously available display units of this type, is light in weight, and is easier to erect or to disassemble and pack for transportation than the previously available display units of this type.

The present invention provides a multi-panel display unit, in which each panel, in a preferred embodiment of the invention, includes a core of lightweight synthetic foam covered by a stiff, relatively hard sheet material, which, in turn, may be covered with a suitable fabric layer. All of these layers are assembled to provide a predetermined total thickness which corresponds to the size of a standard frame assembly. The frame assembly is of a uniform size, regardless of whether the panel faces are of hard material or are cover by fabric.

The frame assembly includes a connector member, and the peripheral surfaces of the panel core are machined specially, providing a groove to accept the connector member in a lockingly mating relationship. The connector member provides a reinforcement of the margins of the panel units, making the previously used wooden frame unnecessary, and connects a protective and supporting metal channel outer frame to the panel units. A bead on one edge of the connector fits in the groove in the core, while edges of face portions of the connector lockingly fit in grooves defined within the channel members of the frame.

In a preferred embodiment of the invention, a latching plunger mechanism is provided to connect a removable portion of the channel frame to the connector members in a releasable manner permitting disassembly and exchange of individual display panels as desired or required in preparation of a particular exhibit. Additionally, in a preferred embodiment of the invention, fabric hinges connect the frames of adjacent panel units and facilitate pivoting movement of each panel unit in either direction relative to the adjacent panel, permitting the several panels of a display unit to be folded compactly for transportation without limiting the ability of the display unit to be erected with the panels in a desired angular relationship to one another.

The invention also provides a fastening device for fastening the frames of upper and lower panel units securely to one another. The fastening device is easily fastened or separated and is self-aligning.

It is therefore a principal object of the present invention to provide an improved folding portable display panel assembly which is economical to produce, and which is sturdy, yet light in weight.

It is another important object of the present invention to provide an improved display panel frame permitting convenient exchangability of individual panel faces of a display unit.

It is yet a further object of the present invention to provide a portable display unit which can be folded into a conveniently portable configuration without removal and potential loss of hinge parts, and which includes a fastener for removably interlocking upper and lower display panel sections with one another.

An important feature of the present invention is a frame assembly including a connector member, which may be a plastic extrusion, and which serves to strengthen the panels of the display unit by being matingly connecting with them, and which also matingly connects an outer frame of metal channel configuration to the panels.

Another important feature of the present invention is the provision of a panel constructed of light, yet strong synthetic plastic foam material covered by a backing layer of strong durable sheet material attached to the core by a pressure sensitive adhesive.

A further important feature of the present invention is the provision of a fabric hinge assembly which permits a panel section to be pivoted through an angle of 360° with respect to an adjacent panel and to lie flat against such adjacent panel regardless of which direction it is pivoted.

Yet another feature of the present invention is the provision of a self-aligning, locking, yet easily releasable, fastener for interconnecting adjacent panel sections, particularly upper and lower sections of a display unit.

It is an important advantage of the present invention that it may be produced at a lower expense than previously available comparable display units.

It is another important advantage of the present invention that it provides a display unit which may be set up or disassembled and packed for shipment without use or removal of any small loose parts.

It is another important advantage of the present invention that it provides a display unit which is more versatile than previously available display units for this purpose.

The foregoing and other objectives, features and advantages of the present invention will be more readily understood upon consideration of the following detailed description of the invention taken in conjunction with the accompanying drawings.

Figure 1:
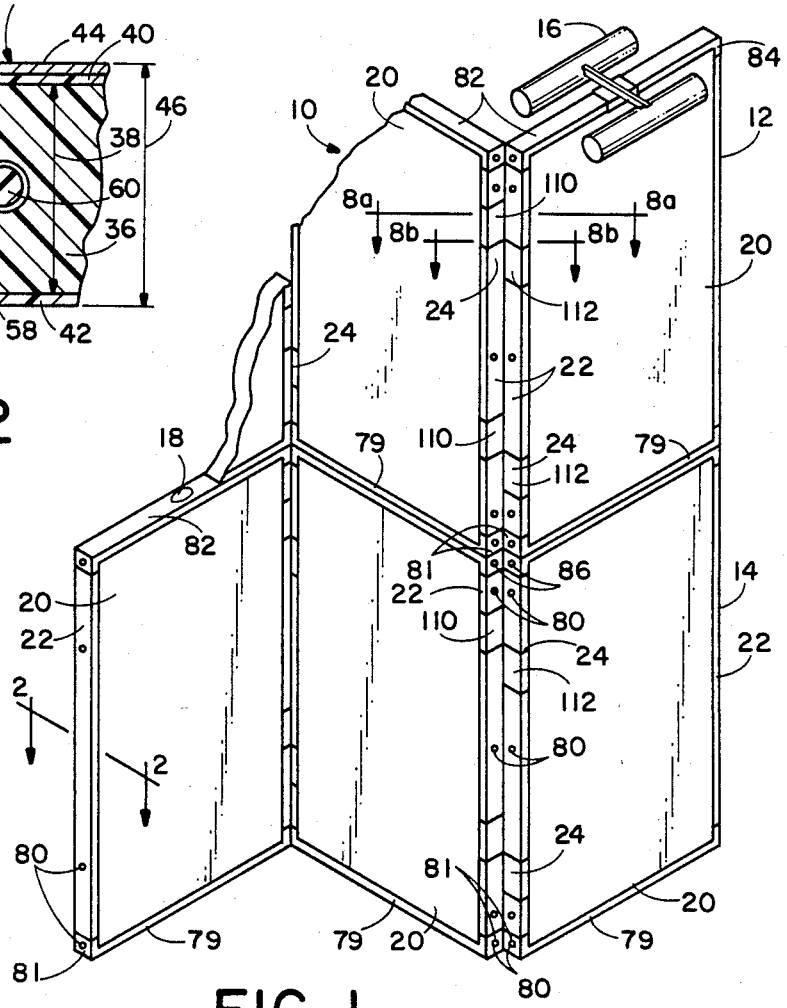
FIG. 1 is a partially cutaway perspective view of a display unit embodying the present invention.

FIG. **8*a* is a sectional view, taken on an enlarged scale along line 8*a*—8*a* of FIG. 1**, showing the construction of the fabric hinges of the display unit of the present invention.

FIG. **8*b* is a sectional view, taken on an enlarged scale along line 8*b*—8*b* of FIG. 1** showing another portion of the hinge construction of the display unit.

Figure 9:
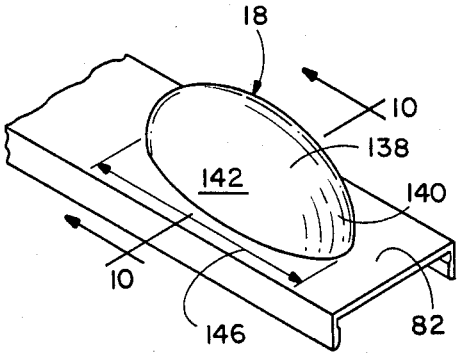

FIG. 9 is a perspective view of a fastener for interconnecting upper and lower panels of a two-tier display unit according to the present invention.

Figure 10:
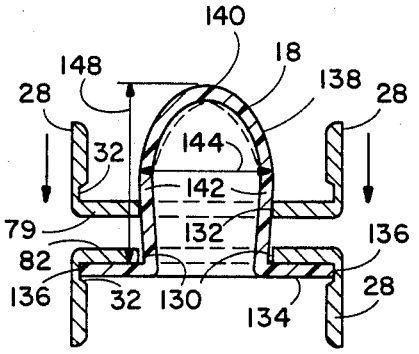

FIG. 10 is a sectional view of the fastener shown in FIG. 9, taken along line 10—10 of FIG. 9.

Figure 11:
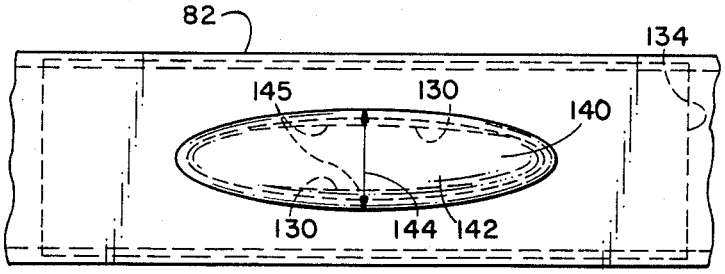

FIG. 11 is a top plan view of the fastener shown in FIG. 9, at an enlarged scale.

DETAILED DESCRIPTION OF THE INVENTION

Referring now to the drawings, in FIG. 1, an exemplary display unit 10, shown partially cut away, includes an upper display unit portion 12 and a lower display unit portion 14. A lamp 16 is mounted on the upper display unit 12, which is removably attached to the lower display unit 14 by a plurality of fasteners 18, one of the fasteners 18 being located atop each of the panel units 20 of the lower display unit 14, and fitting matingly into the bottom of each panel unit of the upper display unit 12. The panel units 20 each include a frame assembly 22, and hinges 24 interconnect the panel units 20 of each of the upper and lower display units 12 and 14, permitting the display panel units 20 to be rotated about the hingedly interconnected edges of adjacent ones of the panel units, through an angle of up to 360°. Each of the upper and lower display units 12, 14 can be folded to a transport configuration (not shown) in which the panel units 20 lie closely side by side, in a zig-zag configuration. Although only three panel units 20 are shown interconnected side by side in FIG. 1, a typical display unit would include five such panel units 20 in each of the upper and lower portions 12, 14.

Figure 2:
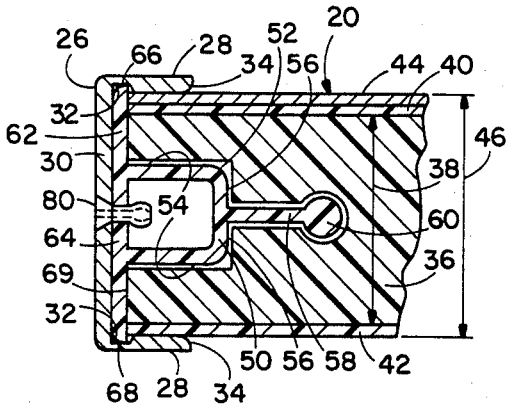
FIG. 2 is a sectional view of a portion of a panel unit shown in FIG. 1, with the frame channel in place.

Referring now to FIG. 2, a marginal portion of one of the display panel units 20 is shown in section view. The frame assembly 22 may be seen to include a U-shaped channel member 26 including a pair of opposite, generally parallel side portions 28, extending generally perpendicularly inwardly of the frame 22, and a peripheral face portion 30. A pair of inwardly-facing base grooves 32 are defined within the interior angles formed between the side portions 28 and the peripheral face portion 30 of the channel member 26.

Each of the parallel sides 28 has what will herein be called beveled edges 34. These beveled edges 34 preferably are actually arcuate as seen in end view as in FIG. 2.

The panel within the frame assembly 22 includes a light, stiff core 36 of material such as a polystyrene foam plastic, which may be as light as two pounds per cubic foot density. The material of the core 36 is cut precisely to the required thickness 38 so that the core 36 plus a pair of backing sheets 40, 42 and an optional layer of fabric 44 supported on one or each of the backing sheets 40, 42 have a total thickness 46 equal to the interior distance between the opposite parallel sides 28 of the U-shaped channel member 26.

Preferably, the backing sheets 40, 42 are of a strong, rigid plastics material such as melamine, available in sheet form from Pioneer Plastics of Auburn, Me. The backing sheets 40, 42 of such material are 0.020 inch thick, for example, and are attached to the core 36 by a pressure-sensitive hot melt adhesive which is sprayed on the backing sheets 40, 42, after which they are pressed against the core 36.

The fabric covering 44 is preferably a nylon fabric having a loop pile face, and may include a thin resilient foam layer (not shown). The fabric 44 is provided so that resilient plastic hook fastening material, such as that manufactured under the trademark Velcro, may be used to attach display materials to the faces of the panel unit 20. The layer of fabric 44 is, however, optional, and the thickness 38 of the core 36 is adjusted so that the display panel fits within the channel 26 members of the frame assembly 22, depending upon whether either or both of the backing sheets 40, 42 are covered by a layer of such fabric 44. Where the layer of fabric 44 is used, it may also be attached to the backing sheet 40, 42 by a hot melt pressure-sensitive adhesive sprayed on the backing sheet. Although the adhesives are not shown as separate layers in the figures of the drawings, it will be understood that an adhesive is present between the core 36 and other layers of the display panel unit 20.

The channel member 26 is attached to the marginal portions of the display panel by a connector 50, which is preferably an extruded elongate resilient plastic member having a spacer body portion 52 which has a pair of laterally apart-spaced faces 54 and a pair of coplanar inner faces 56. A web 58 extends generally inwardly of the frame assembly 22, perpendicular to the inner faces 56, and a bead 60 extends along an inner edge of the web 58. A pair of outer face members 62, 64 are aligned in a single plane perpendicular to the web 58. Each outer face member 62, 64 includes a beveled outer edge 66 or 68, which, as in the case of the beveled edges 34, is preferably of an arcuate configuration.

The dimensions of the outer face members 62, 64 are such that the beveled edges 66, 68 fit snugly within the base grooves 32. The beveled edges 66, 68 thus normally protrude slightly beyond the thickness 46 of the panel unit 20.

Figure 3:
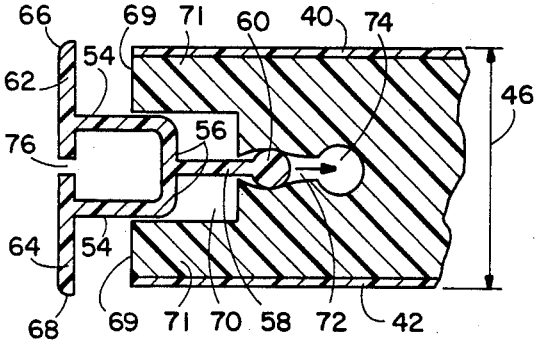
FIG. 3 is a section view of a portion of a partially assembled one of the panels of the display unit shown in FIG. 2, showing the relationship of the connector member to the core of the panel.

As may be seen in FIG. 3, the margins of the core 36, and the edges of the backing sheets 40, 42 coincide, defining generally a peripheral surface 69 along each margin of the panel. A groove 70 defined by a pair of parallel, marginal ribs 71 is formed extending along each of the peripheral surfaces 69 of the panel core 36 and includes a slot 72 and a tubular cavity 74 extending parallel with the peripheral surface 69 of the core 36. The sides of the slot 72 are moved apart slightly when the connector 50 is inserted and then resiliently resume their shape to receive the web 58 and bead 60 of the connector 50 and retain it with the spacer body portion 52 located within the groove 70. The material of the core 36 resiliently grips the bead 60 and web 58, although, for the sake of clarity, this resiliently gripping close contact is not shown in FIGS. 2–4.

Figure 4:
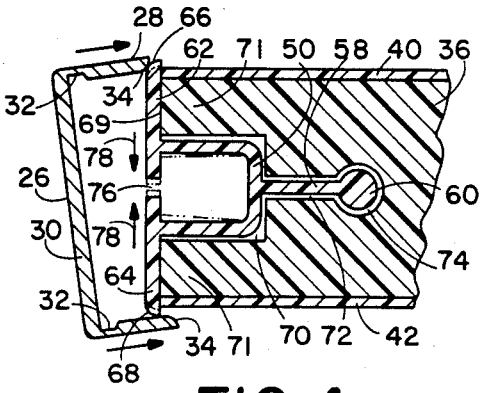
FIG. 4 is a sectional view of the portion of a panel shown in FIG. 3, with the connector member in place and the outer channel member of the frame being put in place.

With the connector 50 extending along the marginal portions of a panel unit 20, the beveled edges 66, 68 protrude slightly beyond the faces of the panel unit, as shown most clearly in FIG. 4, but the outer face members 62, 64 are separated by a space 76. The hollow construction of the spacer body portion 52 permits the face members 62, 64 to be moved resiliently toward one another, as indicated by the arrows 78 in FIG. 4, as the respective beveled edqes 34 of the opposite parallel sides 28 of the channel 26 interact with the beveled edges 66 and 68 of the outer face members 62 and 64. This permits the U-shaped channel member 26 to be pushed onto the marginal portion of the display unit panel 20 as indicated in FIG. 4. When the U-shaped channel member 26 is fully in place the margins of the outer face members 62 and 64 are resiliently mated within the base grooves 32, retaining the U-shaped channel members 26 of the frame assembly 22, respectively, in place about the margins of the panel unit 20 as shown in FIG. 1. Preferably, respective connector members 50 extend along each of the vertical edges and along the bottom of each of the panel units 20, with the connectors 50 either being cut off at a bevel or ending far enough from each corner of the frame assembly 22 to avoid interference. A bottom frame member 79 of U-shaped channel 26 has corner sections of its side walls cut away and has the peripheral face 30 bent upwardly at 90° angles to define end portions 81 which fit over the lower ends of the vertical sections of connectors 50 installed along the vertical margins of the panel units 20.

As shown in FIG. 2, a locking pin 80, which may be a countersunk resilient plastic hollow rivet with a conical core plug which expands an inner end of the locking pin during installation, prevents the outer face members 62 and 64 from moving toward each other as indicated by the arrows 78 in FIG. 4, thus locking the U-shaped channel members 26 in place, mated with the connector members 50 along each margin of the panel unit 20. This fastening also helps maintain alignment of the end portions 81 with the channel members 26 situated along the vertical margins of the panel units 20.

Figure 5:
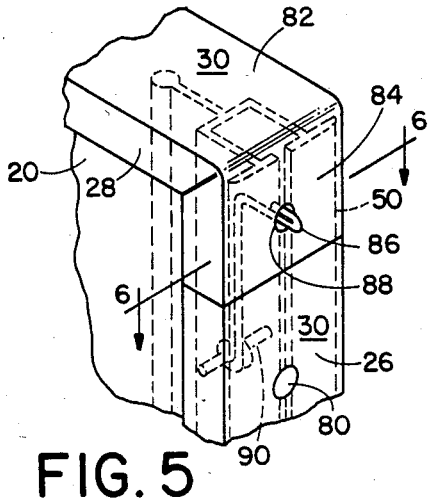
FIG. 5 is a perspective view of an upper corner portion of one panel unit of the display unit shown in FIG. 1, showing attachment of the upper portion of the frame to the remainder of the frame of the panel unit.
Figure 6:
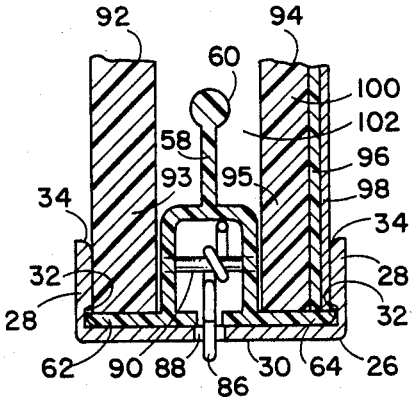
FIG. 6 is a sectional view, taken along line 6—6 of FIG. 5, showing the retainer used to keep the upper portion of the frame channel attached to the vertical side portions of the frame channel members.

Referring now also to FIGS. 5 and 6, the display panel units 20 may be made as are those of the upper display unit 12, shown in FIG. 1, in which an upper frame member 82 which is of U-shaped channel like that of the channel members 26 extends along an upper marginal portion of each of the panel units 20 of the display unit 10. A short downwardly-extending portion 84 is formed at each end of the upper frame member 82 by removing portions of the opposite sides 28 and bending the peripheral face portion 30 downwardly at a 90° angle. A locking plunger detent 86 extends outwardly through a plunger hole 88, holding the upper frame member 82 in place atop the panel unit 20 yet facilitating its removal and replacement. The connector 50 of each vertical side of the panel unit 20 extends upwardly within the downwardly-extending leg 84. The margins of the outer face members 62 and 64 of the connectors 50 extend upwardly within the base grooves 32 of the downwardly-extending leg portions 84, holding the upper frame member 82 properly aligned with the two U-shaped channels 26 extending along the vertical margins of the panel unit 20.

The plunger detent 86 is formed of wire, as an extension of a spring coiled about a transversely extending pin 90 mounted within the spacer body portion 52 of the connector 50, and is biased outwardly thereby to extend through the hole 88.

The display panel unit 20 shown in FIG. 6 is similar to the panel units 20 shown in FIG. 2, except that instead of having a foam core 36 it has a pair of removable opposite display panels 92 and 94, whose margin portions 93, 95 fit in the space between a respective side portion 28 of a channel member 26 and the spacer body portion 52 of the connector 50. The display panel 92, for example, is of a transparent or translucent material, while the display panel 94 includes a hard plastic backing sheet 96, and a fabric cover layer 98, and a core 100 which may be of a lightweight foam material such as that of the core 36. An interior space 102 between the panels 92 and 94 may be illuminated electrically as back lighting for the display panel 92. By releasing the detents 86 and removing the upper frame member 82 the display panels 92 and 94 are released to be exchanged as desired, with the connectors 50 and channel members 26 being kept together by the bottom frame channel member 79.

Figure 7:
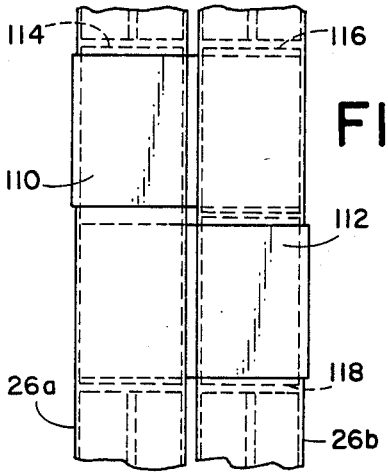
FIG. 7 is a view of a pair of panel units side by side, showing one of the fabric hinges interconnecting the panels.

Referring now to FIGS. 7 and 8, horizontally adjacent ones of the panel units 20 are interconnected with one another by the hinges 24. The hinges 24 include flexible ribbons 110 and 112 which extend crossingly between opposite faces of the adjacent panel units 20, with slack being kept out of the ribbons as well as possible during assembly. At least three of the flexible ribbons, including at least one of each of the ribbons 110 and 112, are necessary to provide a stable hinged connection between adjacent display panel units 20, as will be appreciated presently. Preferably, at least two hinges 24, each having one of the ribbons 110 and one of the ribbons 112, are provided along each hingedly connected side of a display panel unit 20.

Figure 8A:
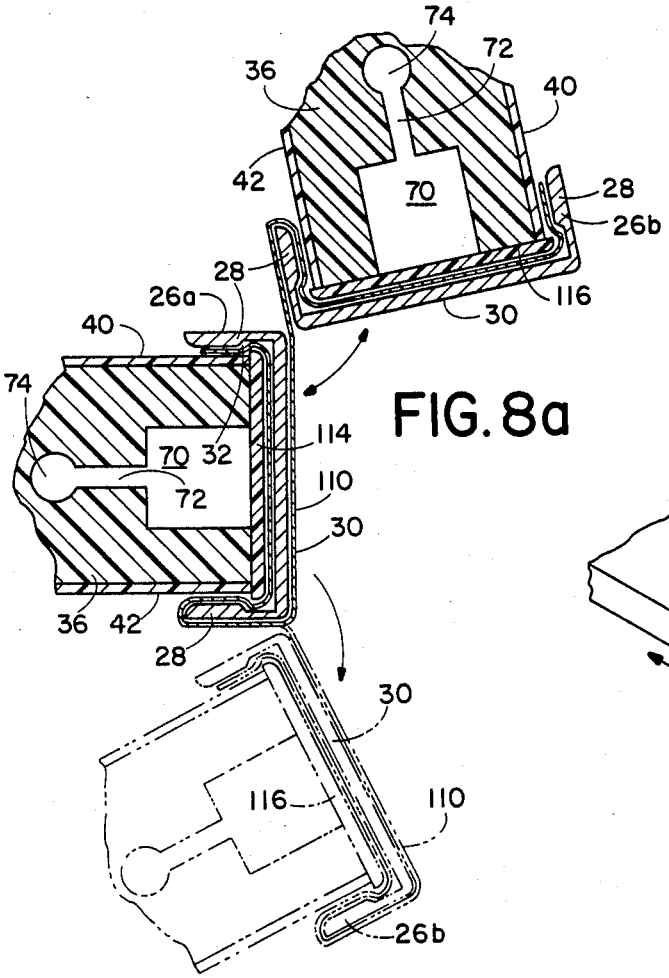
Figure 8B:
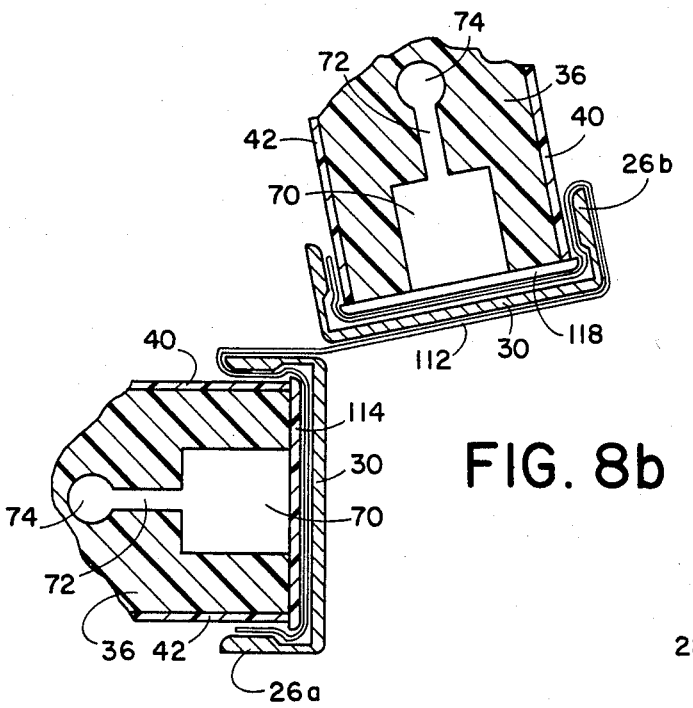

Referring to the U-shaped channel members of a hinge 24 as channel **26*a* and channel 26*b*, shown in FIGS. 7, 8*a*, and 8*b*, a first ribbon retaining plate 114 is engaged in the base grooves 32 of channel member 26*a*, and a pair of ribbon retaining plates 116 (FIG. 8*a*) and 118 (FIG. 8*b*) are similarly engaged in the base grooves 32 of the channel member 26*b*, holding the ribbons 110 and 112 securely attached to the channel members 26*a* and 26*b*. Preferably, the hinge retaining plates 112, 116, 118, are made of a resilient synthetic plastic material, while the flexible ribbons 110 and 112 are of a sturdy woven cloth, such as a heavy satin weave nylon cloth approximately 2 inches wide. As may be seen in FIG. 8*a*, with the panel units 20 in the position shown in FIG. 1, the flexible ribbon member 110 extends around the one of the side portions 28 of the channel 26*a* which is farther from the channel member 26*b*, thence along and in contact with the peripheral face 30 of the channel member 26*a*, and thence along and in contact with the adjacent side portion 28 of the channel member 26*b*. When the panels 20 are rotated with respect to one another from one side to the other of a coplanar alignment, to the position in which the frame member 26*b* is shown in broken line in FIG. 8*a*, the ribbon member 110 is displaced away from the peripheral face portion 30 of the channel member 26*a* and extends instead along the peripheral face 30 of the channel member 26*b***.

Referring now to FIG. **8*b*, the ribbon member 112 is wrapped similarly about the retaining plate 114 within the channel member 26*a*, but extends along the side portion 28 of the channel member 26*a* which is immediately adjacent the channel member 26*b*, extending thence between the channel member 26*a* and the channel member 26*b*, thence along the peripheral face 30 of the channel 26*b* around the distant side portion 28 of the channel member 26*b*. The ribbon member 112 is retained within the channel member 26*b* by a retaining plate member 118**.

The connector 50 is interrupted along the portions of the margins of the panel units 20 where the hinges 24 are located, but it is unnecessary to machine the U-shaped channel member 26 of the frame assembly 22 to receive metal hinges, as is necessary when mounting metal hinges as has been done in the past, and it is unnecessary to disconnect the hinges 24 to fold the display units 20 for storage or shipment.

To interconnect the upper and lower panel units 20 of a panel display device 10 according to the present invention, the horizontal U-shaped channel member 26 at the top of each of the lower display units 14 is provided with an oval aperture 130, and the horizontal U-shaped channel member 26 at the bottom of each of the upper panel units 20 is a socket comprising an essentially identical oval aperture 132, located to be opposite the oval aperture 130 when the upper and lower display units are mated together. The connector member 50 is interrupted within the U-shaped channel member 26 in the vicinity of the oval apertures 130 and 132 on both of the frame assemblies 22 to be connected by the fastener 18.

The fastener 18 includes a base plate portion 134 whose width corresponds to the distance between the base grooves 32 of the U-shaped channel member 26. Centrally located on the base plate 134 and extending from the base plate outwardly through the oval aperture 130 is a bubble-like hollow body 138 of the fastener 18. The entire fastener 18, including the base plate portion 134, is made of a plastic material which is flexible enough for the base plate 134 to snap into place with its lateral edges 136 engaqed in the base grooves 32, when the body 138 of the fastener 18 is pushed through the aperture 130 from within the channel member. The body 138 can be formed within an appropriate die by well known methods, and preferably has a greater wall thickness along a central ridge portion 140 than along the convex lateral faces 142. The hollow body 138, seen in end view along the U-shaped channel members 26 (FIG. 10) resembles slightly more than half of an ellipse. When the body 138 is in a relaxed shape, it has its greatest width 144 at a location shaped a distance above the base plate 134, so that when the body 138 extends through the oval aperture 130 and into the oval aperture 132 the side walls 142 exert an outward pressure against the interior of the oval aperture 132 and extend to a width greater than that of the oval aperture 132 at a location beyond the U-shaped channel member 26 of the upper frame assembly 22, providing a wedgelike grip against removal of the frame assembly 22 of the upper display unit panels 20 from engagement with the corresponding lower panel units 20.

Nevertheless, the shape of the fastener 18 is such that it is self-aligning, since the profile of the hollow body 138, as seen when directly facing the panel 20 is approximately semi-elliptical, while the plan shape is generally elliptical, as may be seen in FIG. 11, where the elliptical base line 145 coincides closely with the shape of the oval aperture 130 and is narrower than the maximum width 144. An exemplary fastener 18 has a body 138 whose length 146 is 1-7/16 inch, with a height 148 of $\frac{1}{2}$ inch, and a width 144 of $\frac{3}{8}$ inch.

The two U-shaped channel members 26, respectively, of the top of a lower panel unit and bottom of an upper panel unit 20, are mated together, pushing the hollow body 138 of the fastener 18 upwardly into the oval aperture 132. The walls 142 thereupon resiliently return, as closely as the shape of the oval aperture 132 permits, to their relaxed state, exerting outward pressure against the interior of the oval aperture 132. The part of the body 138 located within the channel 26 of the upper panel unit 20 is free to bulge outwardly somewhat beyond the confines of the oval aperture 132, to lock the two frame assemblies together securely enough to maintain the integrity of the display unit 10 until it is desired to disassemble the display unit 10. The hollow body 138 is preferably of an ABS plastic, with wall and base thicknesses of, for example, about 1/16 inch.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A display device of the type including at least one flat panel for display of information thereon and having a frame assembly for holding each said flat panel, comprising:

(a) a plurality of elongate generally U-shaped channel members each having a pair of generally parallel side portions spaced apart from each other and interconnected with each other by a peripheral face portion;

(b) at least one elongate connector member located inwardly of and extending parallel with a respective one of said U-shaped channel members, said connector member including an outwardly facing mating portion having a pair of coplanar outer face members extending parallel with said peripheral face portion;

(c) retaining means defined within each of said U-shaped channel members for receiving said outwardly-facing mating portion so as to hold said connector member in mating relationship with said U-shaped chanel member and prevent said U-shaped channel member from moving outwardly away from said connector member;

(d) a spacer body included in said connector member, interconnected with said mating portion and extending inwardly of said frame assembly, said spacer body including a pair of opposite faces spaced laterally apart from each other, each of said opposite faces being spaced a predetermined distance apart from a respective one of said side portions of said U-shaped channel and each of said face members of said mating portion extending outwardly beyond a respective face of said spacer body toward a respective one of said side portions of said U-shaped channel; and (e) means for interconnecting ones of said U-shaped channel members to one another to define said frame assembly.

2. The display device of claim 1 wherein said retaining means includes a base groove defined in at least one of said side portions of said U-shaped channel, said outwardly facing mating portion including a laterally protruding marginal portion of a respective one of said face members located matingly within said base groove.

3. The display device of claim 2, wherein said marginal porton of said face member of said outwardly facing mating portion includes an outwardly facing beveled edge surface, and wherein at least one of said side portions includes an inwardly facing beveled edge surface.

4. The display device of claim 1, said at least one panel including a panel core having a peripheral margin surrounded by said frame assembly, said peripheral margin including a pair of opposite marginal ribs defining a marginal groove in which said spacer body is located, each of said ribs being located between said spacer body and one of said side portions of said U-shaped channel.

5. The display device of claim 1, including a display panel disposed within said frame assembly, said display panel having a panel margin portion held by said frame assembly and extending between said spacer body and a respective one of said side portions of said U-shaped channel.

6. The display device of claim 1, including a pair of opposite display panels disposed within said frame assembly, each said display panel having a panel margin portion held by said frame assembly and extending between said spacer body and a respective one of said side portions of said U-shaped channel, at least one of said display panels being translucent, and said predetermined distance between said spacer body and said side portion corresponding to said predetermined thickness, said display device further comprising means located adjacent said panel for illuminating the interior of said display device within said frame assembly.

7. A display device of the type including a plurality of flat panels for display of information thereon and having a plurality of frame assemblies for holding said flat panel, comprising:

(a) a plurality of elongate generally U-shaped channel members each having a pair of generally parallel side portions spaced apart from each other and interconnected with each other by a peripheral face portion;

(b) at least one elongate connector member located inwardly of and extending parallel with a respective one of said U-shaped channel members and including an outwardly facing mating portion;

(c) retaining means defined within each of said U-shaped channel members for receiving said outwardly-facing mating portion so as to hold said connector member in mating relationship with said U-shaped channel member and prevent said U-shaped channel member from moving outwardly away from said connector member;

(d) a spacer body included in said connector member, interconnected with said mating portion and extending inwardly of said frame assembly, said spacer body including a pair of opposite faces spaced laterally apart from each other and each of said faces being spaced a predetermined distance apart from a respective one of said side portions of said U-shaped channel;

(e) means for interconnecting one of said U-shaped channel members to one another to define said frame assembly; and (f) a plurality of hinge assemblies interconnecting respective ones of said frame assemblies, at least one of said hinge assemblies comprising hinge retaining means for attaching said hinge assemblies to said frame assemblies, said hinge retaining means including:

(i) a pair of opposite base grooves defined in said side portions of said U-shaped channel member;

(ii) at least three ribbon members;

(iii) a first ribbon retainer located matingly engaged in said base grooves of a U-shaped channel member of a first one of said frame assemblies;

(iv) a second and a third ribbon retainer each engaged matingly in said base grooves of an adjacent U-shaped channel member of a second one of said frame assemblies;

(v) a fourth ribbon retainer matingly engaged in said base grooves of said U-shaped channel member of said first frame assembly;

(vi) a fifth ribbon retainer matingly engaged in said base grooves of said channel member of said second frame assembly; and (vii) each of said ribbons extending between said channel members with said channel members located closely adjacent and parallel with one another, said first and second ribbons being connected to said channel member of said first frame assembly by said first ribbon retainer and extending from within said first channel member with one of said first and second ribbons lying alongside each of the opposite ones of said side portions of said first channel of said first frame assembly, said first ribbon being connected to said channel member of said second frame assembly by said second ribbon retainer and said second ribbon being attached to said channel of said second frame assembly by said third ribbon retainer, and said third ribbon being connected to said channel member of said first frame assembly by said fourth ribbon retainer and being attached to said channel member of said second frame assembly by said fifth ribbon retainer, each of said ribbons extending along the respective peripheral face portion of only a respective one of said channel members at any time when said peripheral face portions of said first and second channel members are in any position other than in directly adjacent confrontation with each other.

8. The display device of claim 7 wherein said ribbon retainers are of flat, resilient sheet material, each of said ribbons extending around respective ones of said ribbon retainers between said ribbon retainers and the interior of the respective U-shaped channel member with which the respective ones of said ribbon retainers are matingly engaged, each of said ribbon retainers resiliently grasping a respective one of said ribbons in cooperation with the interior of the respective U-shaped channel member.

9. A display device of the type including at least one flat panel for display of information thereon and having a frame assembly for holding each said flat panel, comprising:

(a) a plurality of elongate generally U-shaped channel members each having a pair of generally parallel side portions spaced apart from each other and interconnected with each other by a peripheral face portion;

(b) a plurality of elongate connector members each located inwardly of and extending parallel with a respective one of said U-shaped channel members and including an outwardly facing mating portion;

(c) retaining means defined within each of said U-shaped channel members for receiving said outwardly-facing mating portion so as to hold said connector member in mating relationship with said U-shaped channel member and prevent said U-shaped channel member from moving outwardly away from said connector member;

(d) a spacer body included in said connector member, interconnected with said mating portion and extending inwardly of said frame assembly, said spacer body including a pair of opposite faces spaced laterally apart from each other and each of said faces being spaced a predetermined distance apart from a respective one of said side portions of said U-shaped channel; and (e) for interconnecting ones of said U-shaped channel members to one another to define said frame assembly, including at least one of said connector members being matingly engaged with at least a portion of each of at least two of said U-shaped channel members.

10. The display device of claim 9, including plunger means located within said spacer body of at least one of said connector members, for releasably fastening the respective connector member to a respective one of said U-shaped channel members.

11. The display device of claim 10 wherein said plunger means includes a depressable detent extending outwardly through said outwardly facing mating portion of said connector member and wherein said peripheral face portion of said respective one of said U-shaped channel members defines a plunger hole for receiving said detent for locking said respective one of said U-shaped channel members to said connector member.

12. A display device, comprising:

(a) a first plurality of display panel units hingedly connected to one another;

(b) a second plurality of display panel units hingedly connected to one another;

(c) fastener means for removably connecting the ones of said firt plurality of display panel units to respective ones of said second plurality of display panel units, each said fastener means including a resilient locking body protruding outwardly from one of said first plurality of panel units toward the respective one of said second plurality of panel units, said locking body having a convexly arcuate shape including a central ridge and a pair of opposite convex side portions which are resiliently compressible toward one another and which include a zone of maximum separation which is spaced apart from said one of said first plurality of panel units; and (d) said respective one of said second plurality of panel units including socket means for matingly receiving said locking body, said socket means including an aperture in a peripheral member of said one of said second plurality of display panel units, said aperture of said socket means corresponding to the shape of said locking body and said aperture having opposite sides between which said locking body can pass only by said opposite convex side portions of said projecting body being temporarily compressed toward one another with said locking body in a predetermined orientation with respect to said socket, and said socket means having room therein for said opposite sides of said locking body to move elastically apart from one another to a distance greater than the separation between said opposite side portions of said aperture, thereby requiring recompression of said side portions of said projecting body toward one another in order for said projecting body to be withdrawn from said socket means, and said locking body and said socket having respective predetermined orientations with respect to said panel units so as to provide a predetermined alignment of said panel units to one another.

13. The display device of claim 12, including one of said projecting bodies located on each of said first plurality of panel units and a corresponding socket menas defined in each of said second plurality of panel units.

14. The display device of claim 12 wherein each of said locking bodies is centrally located on a top marginal surface of a respective one of said first plurality of panel units and projects upwardly and has a substantially elliptical shape as seen from above and a substantially semicircular shape as seen in side view and a generally semielliptical shape as seen in end view.

15. A locking device for interconnecting a pair of adjacent panel units of a display device, each of said panel units having a respective generally planar marginal surface, said locking device holding said panels together with respective marginal surfaces confronting each other substantially in contact with each other, the locking device comprising:

(a) a base plate;

(b) a resiliently compressible body projecting from said base plate and intersecting with said base plate in a substantially elliptical base line;

(c) means for holding said base plate with said resiliently compressible body extending outwardly from said marginal surface of a first one of said adjacent display panel units;

(d) receptacle means defined in said marginal surface of a second one of said adjacent display panel units for matingly receiving said resiliently compressible body, said receptacle means defining an opening through said marginal surface, said opening having a shape corresponding closely with said substantially elliptical base line;

(e) said body including opposite convexly arcuate side surfaces defining a zone of maximum separation from each other, said zone being spaced apart from said base plate a distance greater than the distance from said base plate to said opening, and said receptacle means including room for said body to expand within said receptacle to a size larger than that of said opening and said body being generally semielliptical as seen in side view and generally semielliptical, beyond said zone of maximum separation of said surface, as seen in end view.

16. A locking device for interconnecting a pair of adjacent panel units of a display device, each of said panel units having a respective generally planar marginal surface and said locking device holding said panels together with the respective marginal surfaces confronting each other substantially in contact with each other, the locking device comprising:

(a) a base plate;

(b) a resiliently compressible body projecting from said base plate and intersecting with said base plate in a substantially elliptical base line;

(c) means for holding said base plate with said body extending outwardly from said marginal surface of a first one of said adjacent display panel units;

(d) receptacle means defined in said marginal surface of a second one of said adjacent display panel units for matingly receiving said resilient body, said receptacle means defining an opening through said marginal surface, said opening having a shape corresponding closely with said substantially elliptical base line;

(e) said body including opposite convexly arcuate side surfaces defining a zone of maximum separation from each other spaced apart from said base plate a distance greater than the distance from said base plate to said opening, and said receptacle means including room for said projecting body to expand to a size larger than that of said opening; and (f) said marginal surface of said first one of said display panel units being defined by a frame member of said display panel unit, said frame member including a pair of parallel side portions and an interconnecting periphral face portion, each of said side portions defining a base groove, and said base plate having opposite lateral margins matingly engaged in said base grooves and holding said base plate inwardly adjacent said peripheral face portion, said peripheral face portion defining a frame opening corresponding in shape to said base line, and said hollow body extending outwardly through said frame opening.

17. A display panel assembly, comprising:

(a) a panel core of rigid yet resilient synthetic plastic foam material having a predetermined thickness;

(b) a relatively thin backing layer of a relatively hard material located on each of a pair of parallel opposed major surfaces of said core and attached to said core layer by an adhesive;

(c) said core and said backing layers having corresponding dimensions and defining a plurality of peripheral surfaces, at least one of said peripheral surfaces including a substantially centrally located groove defined by said core;

(d) said core defining a tubular cavity extending parallel with said at least one of said peripheral surfaces and said groove defined therein;

(e) a generally planar slot interconnecting the interior of said tubular cavity with a generally centrally located portion of said groove, said planar slot extending parallel with said tubular cavity, said groove and said peripheral surface; and (f) means interlockingly mated with said tubular cavity and extending through said slot into said groove, for reinforcing a marginal portion of said panel.

18. The panel assembly of claim 17 wherein said means for reinforcing said marginal portion of said panel includes means for attaching a frame member to said panel.

19. The panel assembly of claim 17 further having a connector member which includes a spacer body which fits within said groove, a web extending from said spacer body within and along said slot, a bead attached to said web and extending along and located within said tubular cavity, and an outwardly facing peripheral mating portion including marginal portions extending laterally away from said spacer body beyond said peripheral surface.

* * * * *

UNITED STATES PATENT AND TRADEMARK OFFICE

CERTIFICATE OF CORRECTION

PATENT NO. : 4,722,146

DATED : February 2, 1988

INVENTOR(S) : Matthias D. Kemeny

It is certified that error appears in the above-identified patent and that said Letters Patent is hereby corrected as shown below:

| | | |
|---|---|---|
| Col. 6, | Line 1 | Change "edqes" to --edges--. |
| Col. 8, | Line 26 | Change "engaqed" to --engaged--. |
| Col. 9, | Line 34 | Change "chanel" to --channel--. |
| Col. 12, | Line 4 | After (e) insert --means--; |
| | Line 10 | Change "pIunger" to --plunger--. |
| Col. 13, | Line 1 | Change "menas" to --means--; |
| | Line 42 | Change "said surface" to read --said side surfaces--. |
| Col. 14, | Line 15 | Change "periphral" to --peripheral--. |

Signed and Sealed this

Twenty-eighth Day of November 1989

*Attest:*

JEFFREY M. SAMUELS

*Attesting Officer* *Acting Commissioner of Patents and Trademarks*